US006557303B2

(12) United States Patent
Finke et al.

(10) Patent No.: US 6,557,303 B2
(45) **Date of Patent: *May 6, 2003**

(54) HOUSING FOR AUTOMATIC DOOR MECHANISMS

(75) Inventors: Andreas Finke, Gevelsberg (DE); Andreas Althoff, Hagen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/981,132

(22) Filed: Oct. 17, 2001

(65) Prior Publication Data

US 2002/0069588 A1 Jun. 13, 2002

Related U.S. Application Data

(63) Continuation of application No. 09/415,528, filed on Oct. 8, 1999, now Pat. No. 6,253,492, which is a continuation-in-part of application No. PCT/EP99/00811, filed on Feb. 8, 1999.

(30) Foreign Application Priority Data

Feb. 9, 1998 (DE) ..... 198 04 860

(51) Int. Cl.[7] ..... E05D 15/06; E05D 15/12
(52) U.S. Cl. ..... 49/409; 49/404
(58) Field of Search ..... 160/19, 22, 38, 160/39; 49/404, 409; 52/717.01, 718.04; 16/87.4 R

(56) References Cited

U.S. PATENT DOCUMENTS

| | | | |
|---|---|---|---|
| 1,575,083 | A | 3/1926 | Tracy |
| 2,653,656 | A | 9/1953 | Kuebler |
| 3,297,075 | A | 1/1967 | Howell et al. |
| 3,473,266 | A | 10/1969 | Miller |
| 3,886,685 | A | 6/1975 | Riphagen |
| 3,981,203 | A | 9/1976 | Williams |
| 4,404,770 | A | 9/1983 | Markus |
| 4,452,014 | A | 6/1984 | Markus |
| 5,121,782 | A | 6/1992 | Renkhoff et al. |
| 5,285,837 | A | 2/1994 | Pozzi |
| 5,296,964 | A | 3/1994 | Shopp |
| 5,307,856 | A | 5/1994 | Murray |
| 5,333,663 | A | 8/1994 | Eger |
| 5,365,989 | A | 11/1994 | Eger et al. |
| 5,427,168 | A | 6/1995 | Lohausen |
| 5,581,944 | A | 12/1996 | Kornbrekke et al. |
| 5,673,739 | A | 10/1997 | Brutsaert |
| 5,819,830 | A | 10/1998 | Vereist |
| 6,024,152 | A | 2/2000 | Rosenich |

FOREIGN PATENT DOCUMENTS

| | | |
|---|---|---|
| DE | 3015990 | 11/1971 |
| DE | 3001919 | 7/1981 |
| DE | 3038315 | 7/1982 |
| DE | 29703231 | 5/1997 |
| DE | 19708431 | 10/1997 |

OTHER PUBLICATIONS

Brochure DORMA ST, DORMA TST, Installation of Sliding Doors and Installation of Telescoping Sliding Doors.

*Primary Examiner*—Gregory J. Strimbu
(74) *Attorney, Agent, or Firm*—Nils H. Ljungman & Associates

(57) ABSTRACT

A housing for an automatic door operator comprising a header section, a closing section and a terminal section. The header section includes two legs and a connecting leg which connects the two legs to one another. One of the two legs includes an end portion having a projection with a circular cross-section and an undercut. The closing section includes another projection with a circular cross-section and an indentation at one end and the terminal section at the other end. The closing section is removably attached to the header section through the engagement of the projection of the closing section with the undercut and the engagement of the projection of the one of the two legs and the indentation. The housing serves to house mechanical and electrotechnical components for the automatic the door operator.

20 Claims, 13 Drawing Sheets

HOUSING FOR AUTOMATIC DOOR MECHANISMS

CONTINUING APPLICATION DATA

This application is a continuation of U.S. patent application No. 09/415,528, filed on Oct. 8, 1999 now U.S. Pat. No. 6,253,492. U.S. patent application Ser. No. 09/415,528 is a Continuation-In-Part application of International Patent Application No. PCT/EP99/00811, filed on Feb. 8, 1999, which claims priority from Federal Republic of Germany Patent Application No. 198 04 860.2, filed on Feb. 9, 1998. International Application No. PCT/EP99/00811 was pending as of the filing date of U.S. patent application Ser. No. 09/415,528. The United States was an elected state in International Application No. PCT/EP99/00811.

BACKGROUND OF THE INVENTION

1. Field of the Invention

The present invention relates to a housing for automatic door operators, which housing serves to receive and house mechanical and electrotechnical components, such as running devices, suspension devices for movable door leaves, drive units comprising power transmissions, couplings, motor and displacement tracking equipment, auxiliary drives, control/regulation systems, power packs and sensors. In this case, the housing basically includes a header section comprising two legs arranged at an angle of approximately 90° towards each other, hooked to a base section by means of a location which describes an angle of approximately 45°, with a connecting or interengaging leg extending parallel and conformed thereto, and subsequently positively and non-positively connected. The free leg, that means the header section's protruding leg, presents on its end a conformation permitting to hook preferably without needing essentially any tools another profile that serves as cover for the housing.

In other words, the present invention can relate to a housing for automatic door operators, which housing serves to receive and house mechanical and electronic components, such as running devices, suspension devices for movable door leaves, drive units comprising power transmissions, couplings, motor and displacement tracking equipment, auxiliary drives, control/regulation systems, power packs and sensors. In at least one embodiment, the housing basically can include a header section which comprises two legs arranged at an angle of approximately 90° with respect to each other. The header section can be hooked onto a base section by means of a recessed opening or slot which is at an approximately 45° angle with respect to each of the leg sections. A connecting or interengaging leg can connect the two legs, which connecting leg is parallel to the slot and conformed thereto, and subsequently positively and non-positively connected. The connecting leg can be connected to the other two legs by essentially any type of connecting arrangement or structure, such as bolts, screws, pins, fasteners, welding, adhesive bonding, pressure fittings, clamps, splines, form fittings and contour fittings. What is meant by positively and non-positively connected in at least one embodiment of the present invention is listed in the previous sentence. The free leg, that means the header section's protruding leg, presents on its end a conformation which can permit another profile that serves as a cover for the housing to be hooked onto the protruding leg, preferably without needing any tools.

2. Background Information

Such profiles are well known with automatic door operators for sliding doors, curved sliding doors, as well as swing door operators. In the housing, that usually comprises a header section with a closing section placed thereupon, are arranged the running devices for the sliding leaves with their suspension devices and also the drive units such as a motor, driving wheels and deflection rollers for a toothed belt or, for example, a chain. Furthermore, inside the housing closing section can be located an electronic control/regulation system required for the drive motor and activated by appropriate sensor signals.

Such housings present the disadvantage that, for example, with sliding door operators measuring very often 4 to 5 meters, there are repeated problems when one single person has to remove or replace this type of closing section.

German Patent No. 297 03 231 U1 reveals a smoke detector unit which is linked to a slide channel. Such a smoke detector unit is used for door closers, which smoke detector, in case of smoke development, releases the activated hold open device and to permit the door closer to carry the door into the regular closed position. The slide channel with the smoke detector unit thus form a single unit and are placed in one common housing. In this case, the housing includes a U-shaped cover slipping on a base body. In addition, easily detachable housing covers close the housing ends.

The company brochure DORMA ST, DORMA TST Automatic sliding door installations and Telescopic sliding door installations, for example disclose a sliding door of the before-described type. In that case, the sectional drawings in the brochure represent a mounting section with a simultaneously incorporated roller rail, to which section is connected a partially pivotable non-detachable cover. Pivoting the cover is realized by a plastic clip provided at the connection to the mounting section and giving a limited room to move. When in its pivoted position, the cover has to be blocked by holder.

OBJECT OF THE INVENTION

Therefore the object of the invention is to improve the imperfections of the state of the art by providing a small housing suitable to receive substantially all components for automatic doors, moreover to be utilized for sliding door operators as well as for swing door operators whereby the assembly should be easy to perform and the opening of such housings should be realized without needing essentially any tools.

SUMMARY OF THE INVENTION

In at least one embodiment of the present invention, the object can be achieved in a housing which includes a header section basically constructed of two legs arranged at an angle of approximately 90° with respect to each other and linked by a connecting leg. The header section can be hooked onto and positively and non-positively fastened to a wall or building section by means of a recessed opening or slot which is at an approximately 45° angle with respect to each of the leg sections. A connecting or interengaging leg can connect the two legs, which connecting leg is parallel to the slot and conformed thereto, and subsequently positively and non-positively connected. The protruding leg of the header section presents on its free end a rounded projection to which is associated an undercut conformed to a web directed towards the housing interior, which undercut becoming later a leg which extends parallel to the protruding leg. At the free end of the leg is arranged a deflecting holding leg limited by a ball-shaped projection and joined by a pivotable closing section which is fixable by means of an interengagement. At the closing section's end can be placed a terminal section as well as end caps to be mounted at the header section's fronts. Further possible embodiments of the present invention are discussed hereinbelow in the features of the present invention.

In this case, the housing can include a header section basically comprising two legs arranged at an angle of approximately 90° towards each other and linked by a connecting leg, hooked to a base section by means of a location which describes an angle of approximately 45°, and simultaneously conformed at the thereto parallel extending connecting legs, and subsequently positively and non-positively connected to the base section. The protruding leg of the header section can be provided with an interengagement for the closing section that builds the cover to the outside, in a way that the closing section can come to a substantially secure attachment through the interengagement with the leg of the header section.

In other words, in at least one embodiment according to the present invention, the housing can include a header section which basically comprises two legs that are arranged at an angle of about 90° with respect to each other and linked by a connecting leg. The header section can be hooked to a base section by means of a location or slot formed between the connecting leg and a hook portion which is positioned at a similar angle as the connecting leg. The hook portion can extend from the header section at approximately a 45° angle with respect to the two legs. The hook portion and slot can permit a positive and non-positive connection of the header section to the base section. The protruding leg of the header section can be provided with an interengagement for the closing section that builds the cover to the outside, in a way that the closing section can come to a substantially secure attachment through the interengagement with the leg of the header section.

The closing section can later be fastened by means of locking elements inside the housing. Separately mounted end caps can be placed at the header sections fronts. For this reason, it can be possible to produce such housings as light metal extruded sections and to cut them to the desired drive's length.

A carrier leg and a support leg, both directed to the housing inside, can simultaneously be conformed to the header section. The carrier leg can serve to receive a separate running profile, to move the carrier rollers of the trolley for the automatic sliding leaf. Moreover, the running surface can be exchangeable and simultaneously via the dead stops conceived as stoppers, which connect the roller rail respectively on the ends with the carrier leg. As the running surface is exchangeable, it is hereby possible to employ different running surfaces corresponding to the desired application type, that means also corresponding to the door leaf's weight. In this case, the running surfaces may be larger, smaller, with straight or rounded surface, developed in a convex or concave form, whereby the rollers corresponding to the running surface can be adapted to the chosen form. With the intention to prevent such leaf from falling out of the installation respectively to exclude any malfunction of the door through non-intentioned removal, these running devices are also provided with support rollers. This support roller leans on the before-mentioned support leg which running surface is concave.

In other words and according to at least one embodiment of the present invention, a carrier leg and a support leg, both extending towards the inside of the housing, can simultaneously be conformed to the header section. The carrier leg can serve to receive a separate running profile, on which profile can move the carrier rollers of the trolley for the automatic sliding leaf. Moreover, the running surface can be replaceable and can have dead stops conceived as stoppers which can connect the roller rail on each end with the carrier leg. Since the running surface can be changed or replaced, it is thereby possible to employ different running surfaces corresponding to the desired type of use. For example, door leaves of different size and weight may utilize different types of running surfaces. In this case, the running surfaces may be larger or smaller with substantially flat surfaces or rounded surfaces developed in a convex or concave form, whereby the rollers corresponding to the running surface can be adapted to the chosen surface. These running devices can also be provided with support rollers with the intent of preventing the corresponding door leaves from falling out of the installation, which can in turn prevent essentially any malfunction of the door through unintentioned removal of the leaves. This support roller can lean on the before-mentioned support leg which can have a concave running surface.

A space can be provided above the support leg arranged by means of a connecting leg between the header section's legs, which are offset by approximately 90°. Inside this space may be formed a channel by means of cable duct sections employed in at least partial zones for the junction wires to be laid within the drive.

The end portion of the-protruding leg of the header section is formed in a way to receive in the first place a closing section (removable) and in the second place an additional section (fixed). In this case, the closing section presents a convexedly formed conformation as a ball-shaped projection, whereby a material contraction follows the conformation; that is to say there is a leg respectively a web that is thinner than the convex conformation. In continuation of the before-mentioned web or leg, inside the closing section follows an indentation that is directed towards the housing inside, to receive a conformation likewise conformed to the leg of the header section, but offset by approximately 90° with regard to the removable closing section's conformation. This conformation is likewise ball-shaped and presents in continuation thereto, alike the removable closing section, a web respectively a tapered section. The contraction leads into by an approximately 90° offset web or leg of the stationary header section, whereby this part also exhibits an indentation, which is built in a way to realise the engagement of the ball-shaped conformation of the removable housing part. With the intention to avoid noise production respectively to guarantee a regular fastening of the closing section, the convex conformations are at least in partial zones covered with a plastic shell. By doing so, in the moment when the removable closing section is inserted into the indentation of the stationary header section and pulled down, the interengagement of both individual housing parts to each other is simultaneously guaranteed. This is a positive connection that may release the positive locking with little effort without requiring a tool, whereby it is simultaneously possible to remove the closing section.

In other words, the end portion of the protruding leg of the header section can be formed in a way to receive in the first place a removable closing section and in the second place a fixable or fixed additional section. In this case, the closing section can present a convex-shaped structure or ball-shaped projection, which can be connected to a leg or a web that is thinner than the convex structure. Inside the closing section can be located an indentation that faces towards the housing inside and is contiguous with and immediately adjacent to the before-mentioned web or leg. The indentation can be shaped to receive a structure connected to the leg of the header section, but offset by approximately 90° with regard to the removable closing section's structure. The structure of the header section can likewise be ball-shaped and can present, like the removable closing section, a web with a tapered section. The tapering can form into an approximately 90° offset web or leg of the stationary header section, whereby this part also can be contiguous with an indentation, which indentation is built in a way to engage with the ball-shaped conformation of the removable housing part. With the intention to avoid noise production as well as to essentially guarantee a regular fastening of the closing section, the convex structures can be at least partially covered with a plastic shell. By using the plastic shell, in the moment when the removable closing section is inserted into the indentation of the stationary header section and pulled down, the interengagement of both individual housing parts to each other can simultaneously be essentially guaranteed. This is a positive connection that may release the positive locking with little effort without requiring a tool, whereby it is simultaneously possible to remove the closing section.

Depending on the application situation, the housing may be realized as a closed housing, or, in case of sliding doors, it may also be conceived as being open downwards. For this latter application, an additional terminal section can be attached to an inside-directed leg of the closing section. This terminal section may be linked in a positive and non-positive connection with the closing section by means of screwing or gluing. According to the application intention, the terminal section can be variable in its length, with a possible extension as far as the leg of the header section, which is attached to the base section.

In a further embodiment of the housing according to the present invention, it is possible to incorporate other components in the housing. A casing for the control/regulation can be made of an extruded metal section whereby simultaneously grooves are provided in the circular legs, which grooves support the insertion of boards equipped with electronic components. Shutters can close the casing on its lateral side. Consequently a casing has been designed that is hermetically protected against exterior parasitic induction. Of course, a power pack or energy supply may be arranged inside this casing. This casing, as well as other optional equipment, conceived in a different way according to the desired range of application, can be mounted by means of mounting plates, which are inserted into undercut grooves in the stationary header section and secured by appropriate screwing means. This method can be very functional, as such extruded metal sections may be in each case cut to the desired length.

When using an additional section that builds so to say a prolongation of the header section's protruding leg and thus a widening of the housing, the additional section's end portion is executed like the header section's end. The header-section's end portion interacts in a similar way as the closing section, in an interengagement as described before. Nevertheless the additional section is positively and non-positively linked to the header section by means of a screwed connection and, unlike the closing section, is not detachable once it is pivoted.

The above discussed embodiments of the present invention will be described further hereinbelow with reference to the accompanying figures. When the word "invention" is used in this specification, the word "invention" includes "inventions," that is, the plural of "invention." By stating "invention," the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention will be explained in detail on the basis of several possible diagrammatically represented embodiment examples in the following figures.

DESCRIPTION OF THE PREFERRED EMBODIMENT

Figure 1:
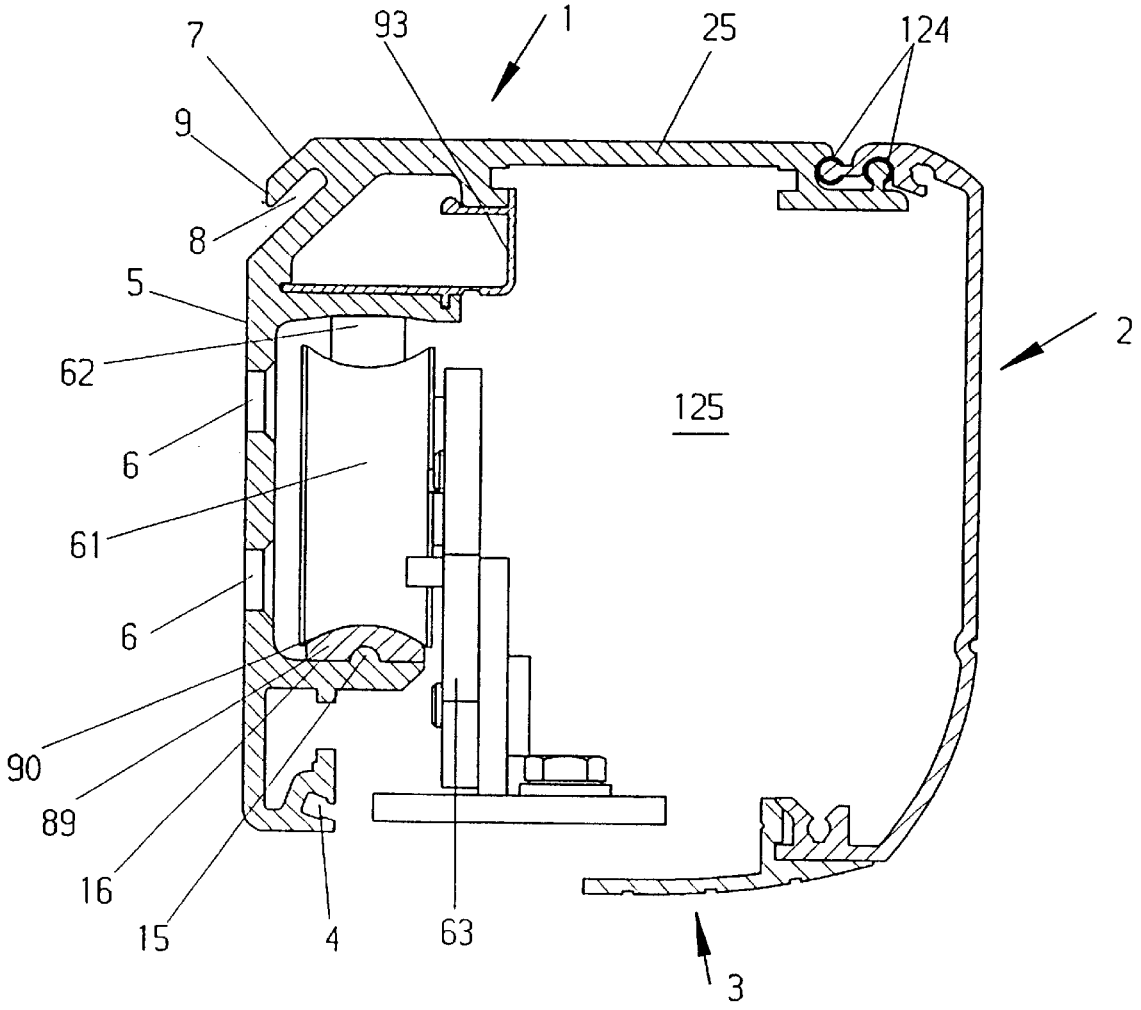
FIG. 1 shows a sectional drawing of the housing with a header section with adjoining closing section and terminal section.

FIG. 1 represents a housing, which for example can be utilized for a sliding door, whereby the sliding leaves are not shown. In this case, the housing is illustrated in a sectional drawing transverse with regard to the longitudinal direction. For completeness, it is mentioned that such housings may also be utilized for swing door operators, though the embodiment examples exclusively refer to the application in a sliding door operator as well as a curved sliding door operator. The housing basically comprises a header section 1 followed by a closing section 2, to which is connected a terminal section 3. Inside the housing is featured a device in the form of a trolley 63 with roller 61 connected thereto and with a support roller 62.

Figure 2:
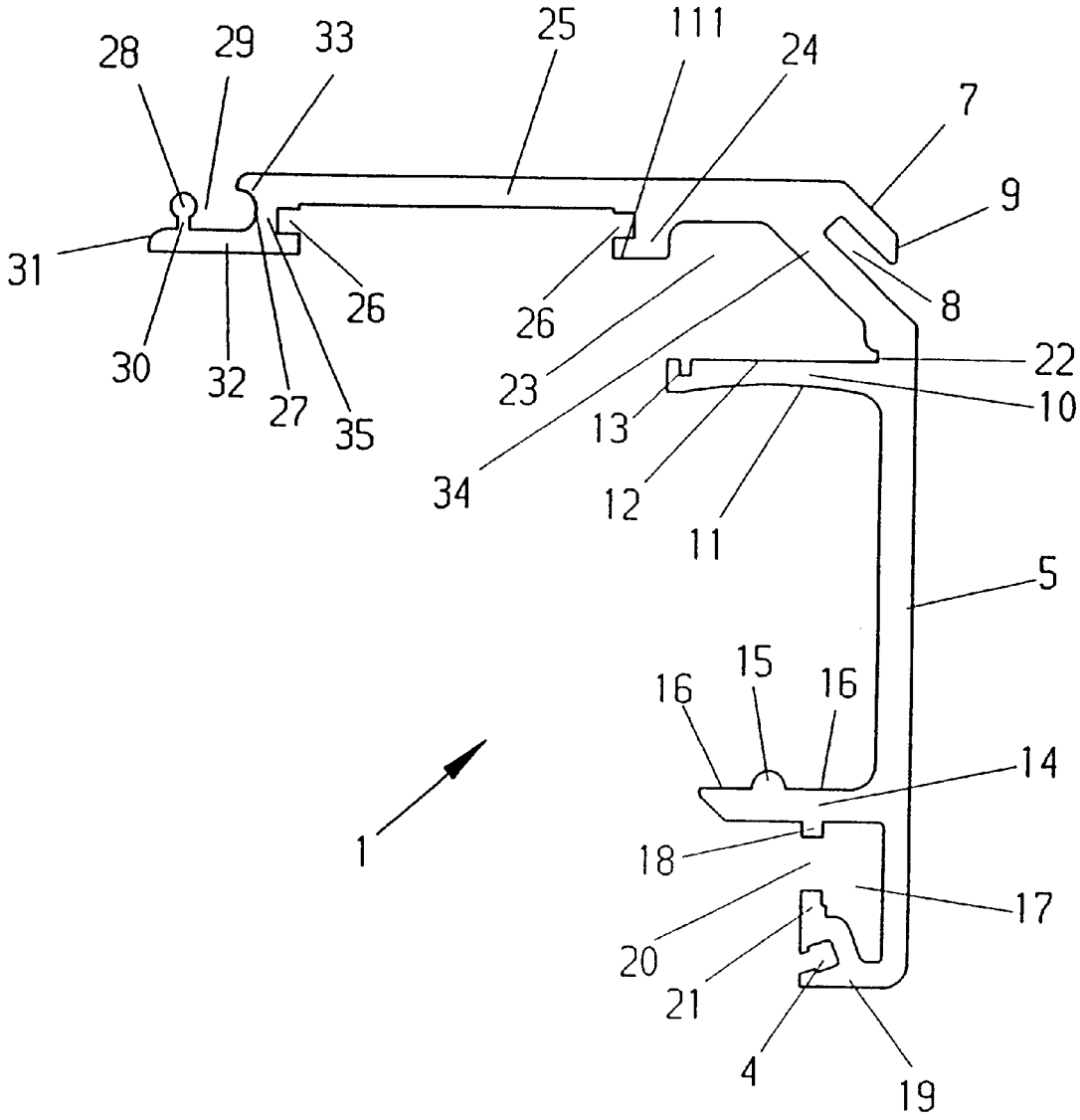
FIG. 2 shows a detailed drawing of the header section.

In this case, the header section 1 basically comprises two legs 5, 25 that are, as represented by the embodiment example as shown in FIG. 2, positively and non-positively connected with each other by means of the connecting leg 34. Due to this conception, leg 25 is to be considered as a protruding component of the header section when compared to leg 5, as leg 5 may be fastened positively and non-positively via fastening holes 6 to a non-represented base or wall section, as well as to a girder of the sub-construction. In further development of the present invention and for an even improved fixing, a special section may be put to use at which the header section is suspended prior to being screwed. This is made possible by means of a leg-shaped ramp 7 which extends parallel to the connecting leg 34. The location 8 for the base profile arranged between the connecting leg 34 and the ramp 7 offers the possibility to suspend the header section 1, in which all components for the sliding door are pre-mounted, at the base profile and to fasten it with the latter thereafter through fastening holes 6. With the intention to realize the suspension without any substantial problem, the ramp 7 is provided with a recess 9 with regard to or corresponding to the leg 5. The free end of leg 5 leads into a leg 19 offset by approximately 90 ° and thus oriented into the direction of leg 25, with an end portion presenting a brush channel 4 into which—not illustrated-in the drawings—a brush may be installed to close the remaining slot between a projection 21 likewise found on the leg 19 and the end of the employed terminal section 3.

As shown in FIG. 2, a carrier leg 14 is arranged at the upper part of the leg 19, again at an angle of approximately 90° with regard to leg 5. The underside of carrier leg 14 has a projection 18 creating in conjunction with projection 21 a hollow space 17 having an aperture 20. The carrier leg's 14 upper side exhibits straight supporting surfaces 16 interrupted by an outwardly directed projection 15. Furthermore, a support leg 10 conformed to the leg 5 extends likewise offset by approximately 90° with regard to the leg 5. The lower surface of support leg 10 is equipped with a running surface 11 which is slightly curved or shaped in a concave manner. The trolleys 63 support roller 62 which leans against the running surface 11. The support leg 10 presents on its upper side, that is to say on the opposite side of running surface 11, a locating face 12 which is flat. Furthermore, at the end of the protruding support leg 10 is provided a groove 13. A hollow space 23 in the area of connecting leg 34 is created by the support leg 10 and the running leg 25 extending parallel thereto. The hollow space 23 is for example limited by the projection 24 presenting a recess 26 designed in a way that the recess 26 points in the direction of the protruding end of leg 25. On the opposite side, close to the end of leg 25, is provided another recess 26 so that due to recess 26 inside the projection 24, recess 26 within web 35 can be used to integrate or house, for example, components required for an automatic door operator at essentially any place without any problem.

The leg's 25 free end presents a projection 33 to which an undercut 27 is associated in the form of an almost arc of circle contour. The contour of undercut 27 stretches out inside the web 35 and ends within a leg 32 which extends parallel to leg 25 but is offset by the extension of web 35. The web 32 has on its end a curvature 31 whereby close to its end exists a holding leg 30 offset by approximately 90° with regard to leg 32. The end of holding leg 30 extends into a ball-shaped projection 28. A free space 29 is built between the leg 30 with its ball-shaped projection 28 and the undercut 27.

Figure 3:
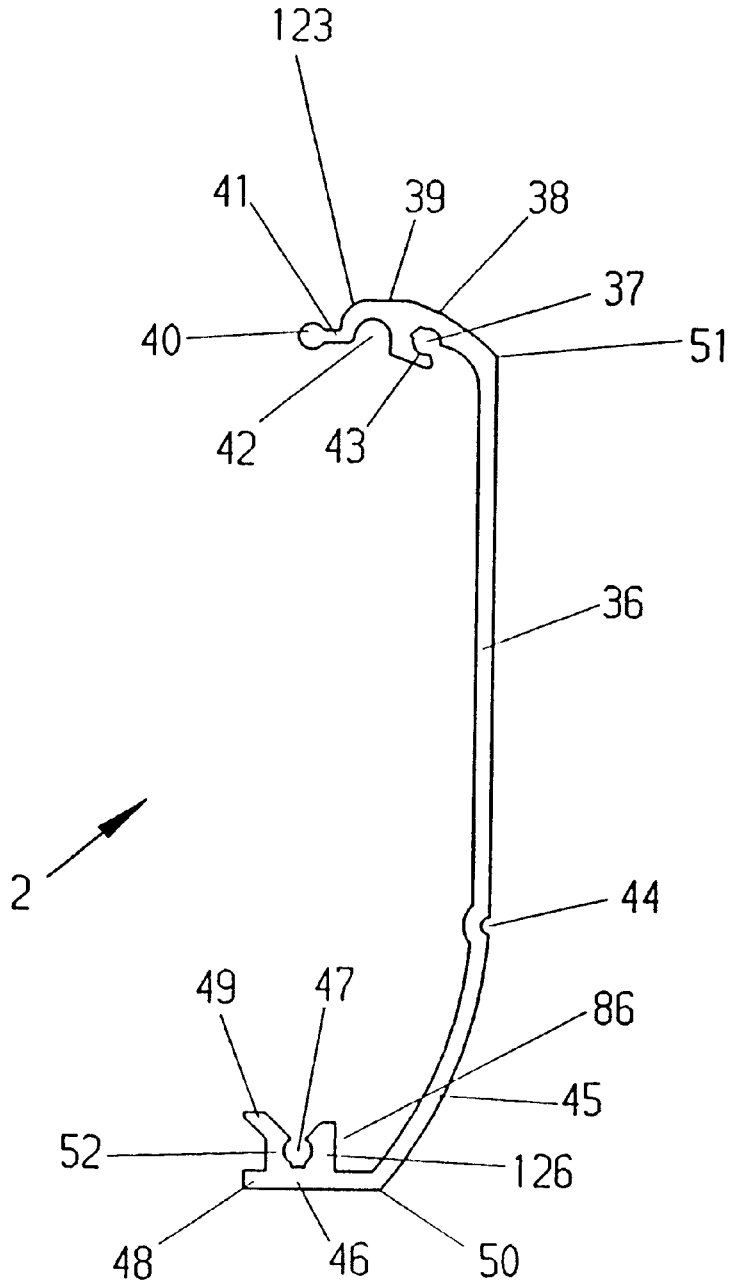
FIG. 3 shows a detailed drawing of the closing section.

Together with the before described header section 1, the closing section 2, as illustrated in FIG. 1, is ready for use. In this case, the closing section 2 basically includes an elongated leg 36 being limited on its one end by an edge 51 and on its other end by a recess 44, as can be seen in FIG. 3. A slightly curved leg 38, becoming later leg 39, offset by approximately 90° with regard to leg 36, follows the edge 51. When looking closer at the contour of leg 39, it passes from a curvature 123 into a holding leg 41, which free end presents a ball-shaped projection 40. There is a recess or indentation 42 between the holding leg 41 and a projection 43 departing from leg 39, which indentation is required for the interengagement of the closing section 2 with the header section 1. Due to the pattern of holding leg 41 in the end portion of header section 1, it is possible to realize, as illustrated in FIG. 1, the interengagement of both sections to each other without needing essentially any tools. With the intention to achieve a durable interengagement, the ball-shaped projections 28 and 40 are respectively equipped with a liner 124, preferably made in the form of a plastic layer. This type of connection allows an easy assembly and likewise disassembly without tools. Moreover there are no locking parts protruding either outside or inside the housing interior 125.

The leg 45 of closing section 2 found adjacent to the recess 44 is slightly bent towards the housing interior 125 and ends at an edge 50. To this edge 50 is connected a leg 46 having a straight projection 48 at its end and a projection 52 offset by approximately 90° with respect to the projection 48 and directed to the housing interior 125 with an attached, slightly-biased projection 49. There is another projection 126 substantially parallel with respect to the before-mentioned projection 52, so that a screw channel 47 is created between the projection 126 and the projection 52. To complete the description, it is to say that there is an undercut 86 between the projection 126 and the leg 45 which forms a hollow space inside the housing interior 125.

Figure 4:
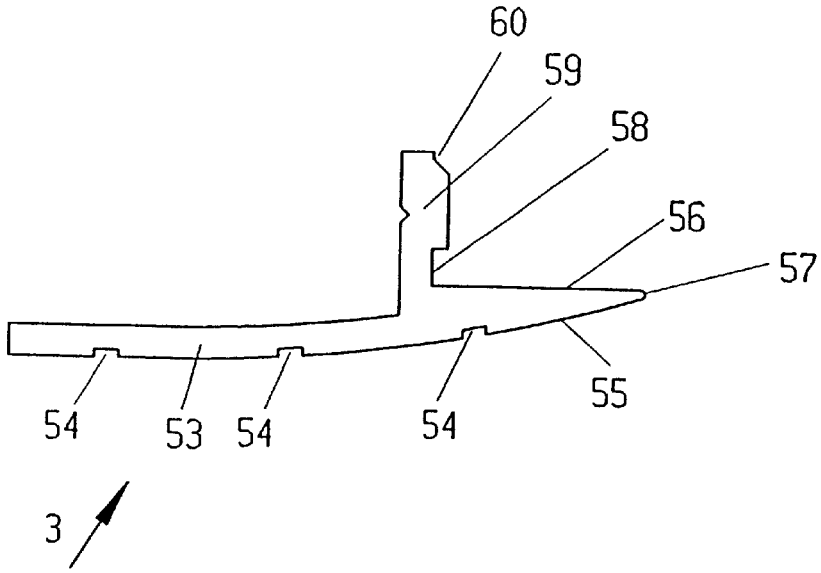
FIG. 4 shows a detailed drawing of the terminal section.
Figure 5:
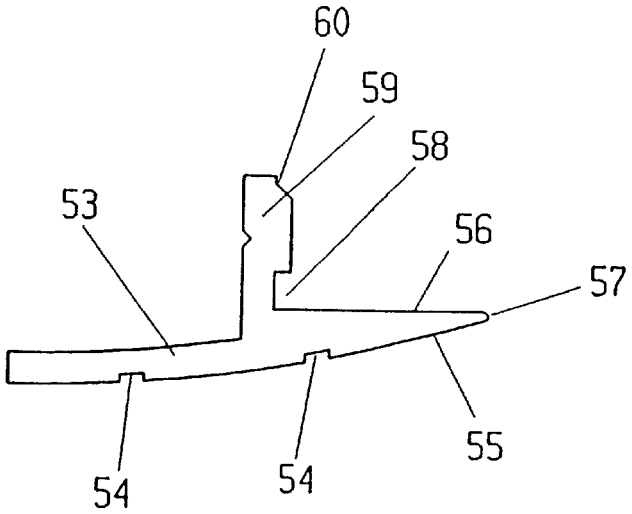
FIG. 5 shows a detailed drawing of the terminal section according to another possible embodiment of the present invention.
Figure 9:
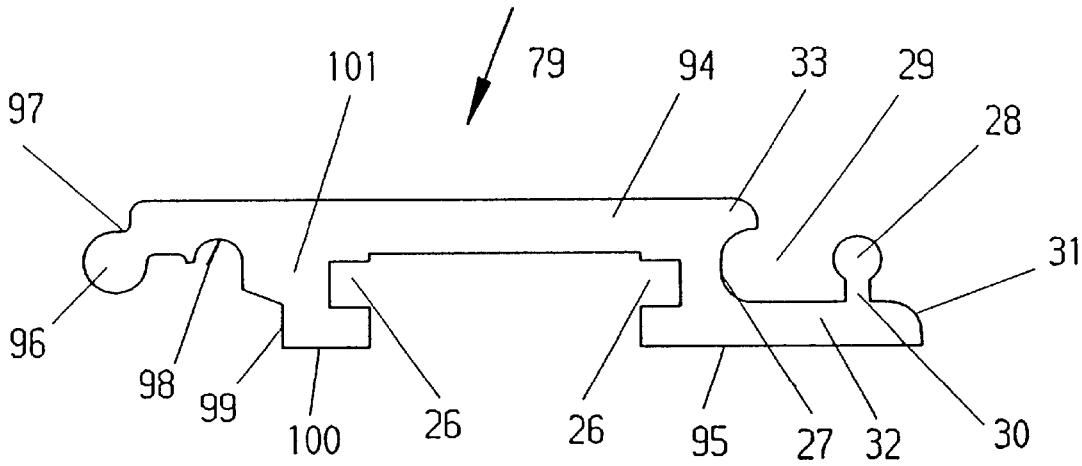
FIG. 9 shows a detailed drawing of the additional section.

A terminal section 3 may be used in conjunction with the end of projection 48 of closing section 2. This terminal section 3 is disclosed in two different lengths by the FIGS. 4 and 5. A surface 56 of terminal section 3 leans on the underside of leg 46. The straight projection 48 of closing section 2 thereby stretches out into an indent 58 of terminal section 3. The indent is integrated in a leg 59, which is offset by approximately 90° with regard to the surface 56. The leg's 59 end presents a ramp 60, which lies close to the biased projection 49. The terminal section 3, placed in that way, is either glued to the closing section 2 or connected positively and non-positively by a screwed connection not visible to the outside. The exterior shape of terminal section 3 shows a curved contour 55, the end of which runs with surface 56 into a slightly rounded peak 57. Here, the contour 55 is interrupted by grooves 54 located in the prolongation of leg 59 inside the convex leg 53. Due to the differing lengths of leg 53, it is possible to completely close the housing or to close it just partially. Thus it is substantially obvious that a header section, a closing section and a terminal section can build a housing of the type according to at least one embodiment of the present invention. In case a bigger housing is requested, this may be realized, for example, by using an additional header section 79. The additional header section 79 is illustrated by FIG. 9. It includes basically a straight leg 94, one end of which presents a projection 33 and thus also the same execution as already described for the end of header section 1 in FIG. 2. Therefore one end of the header section 1 and one end of the additional header section 79 are equipped in substantially the same way.

In order to connect the additional header section 79 to the header section 1, the other end of leg 94 is designed in a similar way as the end execution of the closing section 2. Therefore, an offset 97 is provided to which is linked a ball-shaped conformation 96. In continuation of the ball-shaped conformation 96 follows a ball bed 98 into which the ball-shaped projection 28 engages in the moment when the profiles interengage. Simultaneously there is a projection 101 with a locating face 99 that leans on the projection 31 of header section 1. Between both end executions, again recesses 26 are provided as already described in FIG. 2 illustrating the header section 1.

Figure 8:
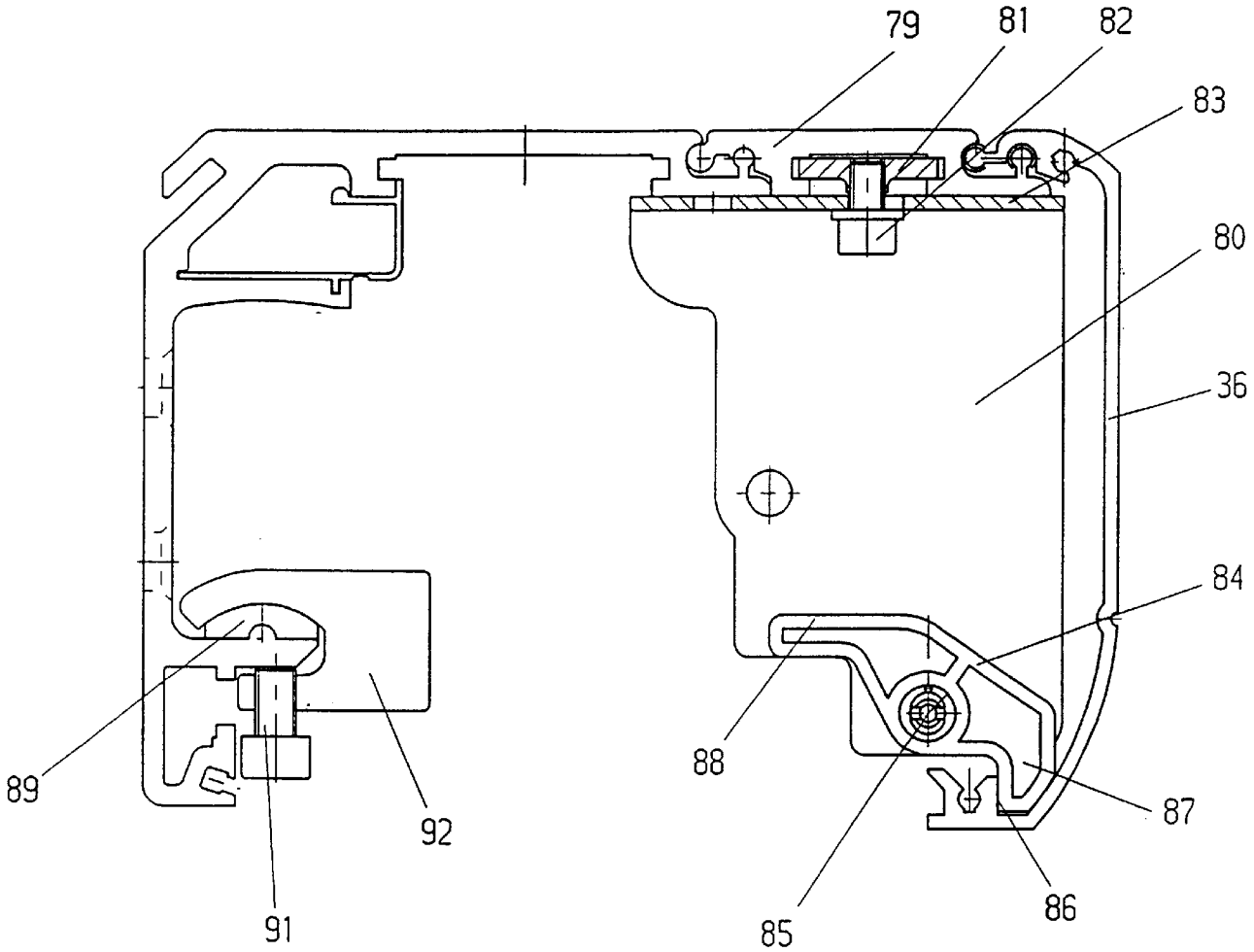
FIG. 8 shows a sectional view taken of the housing according to FIG. 1, but with additionally inserted additional section and interengagement of the closing section.
Figure 12:
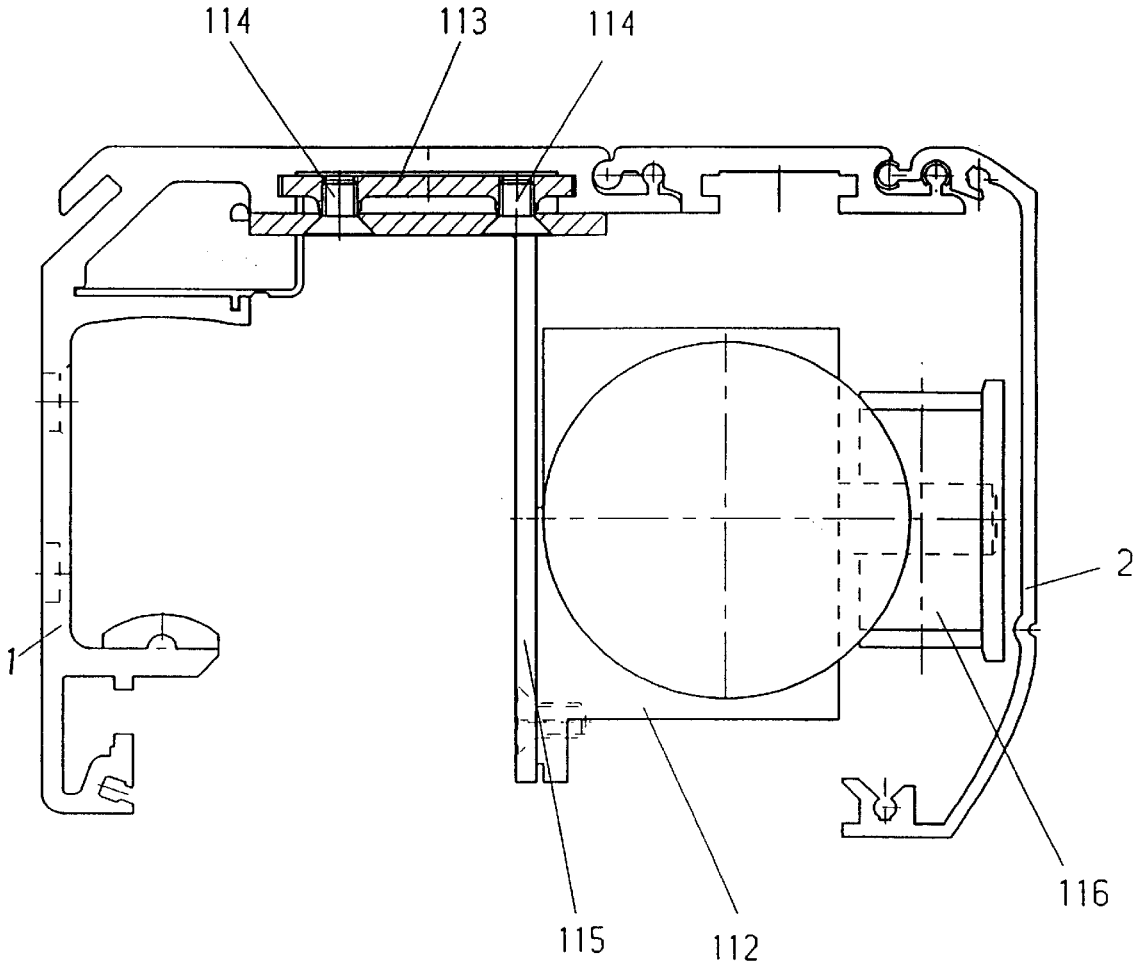
FIG. 12 shows a sectional drawing of a housing with additional section and installed drive motor.
Figure 13:
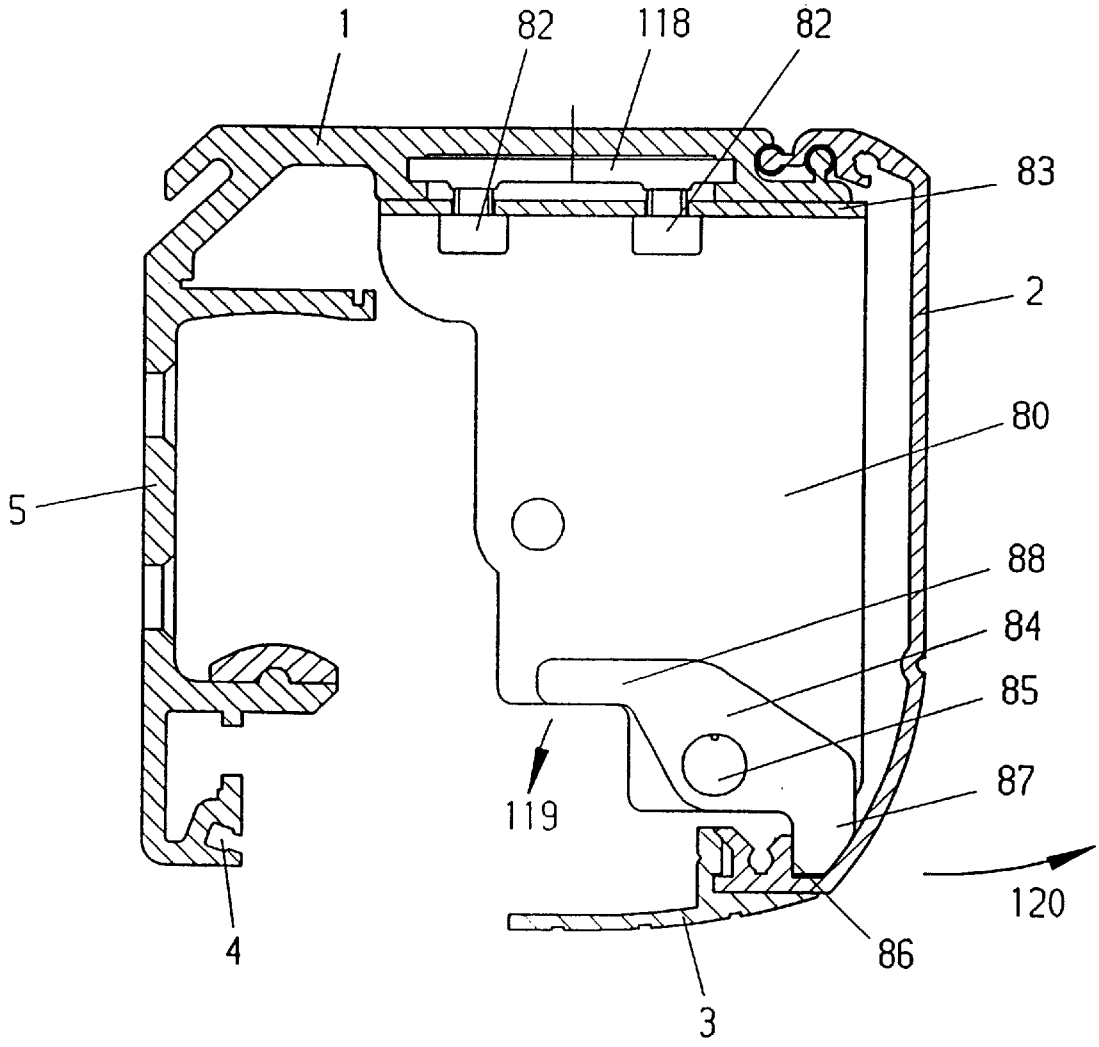
FIG. 13 shows the housing as in FIG. 1, but with a shutter of the closing section.

It is, for example, possible, as shown in FIG. 8, to put in and/or to insert a mounting plate 81 between the recesses 26, to which mounting plate, for example, via a screw connection 82, a corner part 83 for a notched strap 80 is positively and non-positively connected to the housing. Besides the before-described notched strap 80, other components for a sliding door operator may be utilized. This is also shown in FIG. 12, whereby in this embodiment example, a retention plate 113, holding a retention bracket 115 of a motor 112 by means of screw connections 114, is inserted between the recesses 26 in the header section 1. In this example, a drive pulley 116 for the drive belt is arranged at the motor 112. Through these two embodiment examples, it is obvious that in the rear housing area as well as in the front housing area at either location, most differing components may be attached, as well with one as with two screwed connections 82 as shown by the embodiment example in FIG. 13 illustrated with mounting plate 118.

Figure 6:
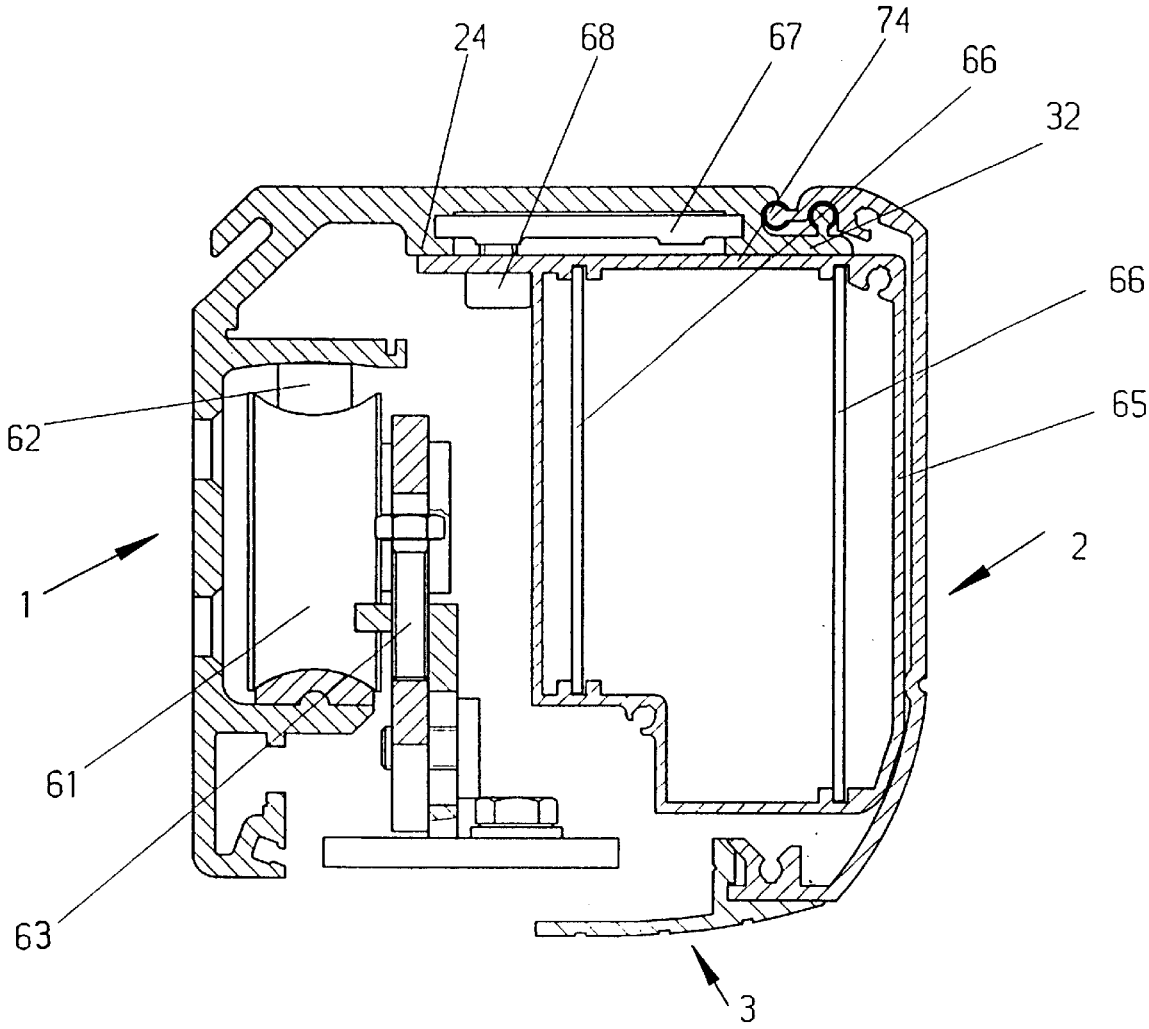
FIG. 6 shows a housing of the before described type with an integrated closed casing for electrotechnical equipment.

FIG. 6 illustrates the fastening of a closed casing 65 that is especially used for control and regulation equipment and power packs. Here the closed casing 65 is held in place by means of a mounting plate 67 and the therein incorporated screwed connection 68. In this configuration, an exterior wall of leg 74 of the closed casing 65 is adjacent the leg 32.

Figure 7:
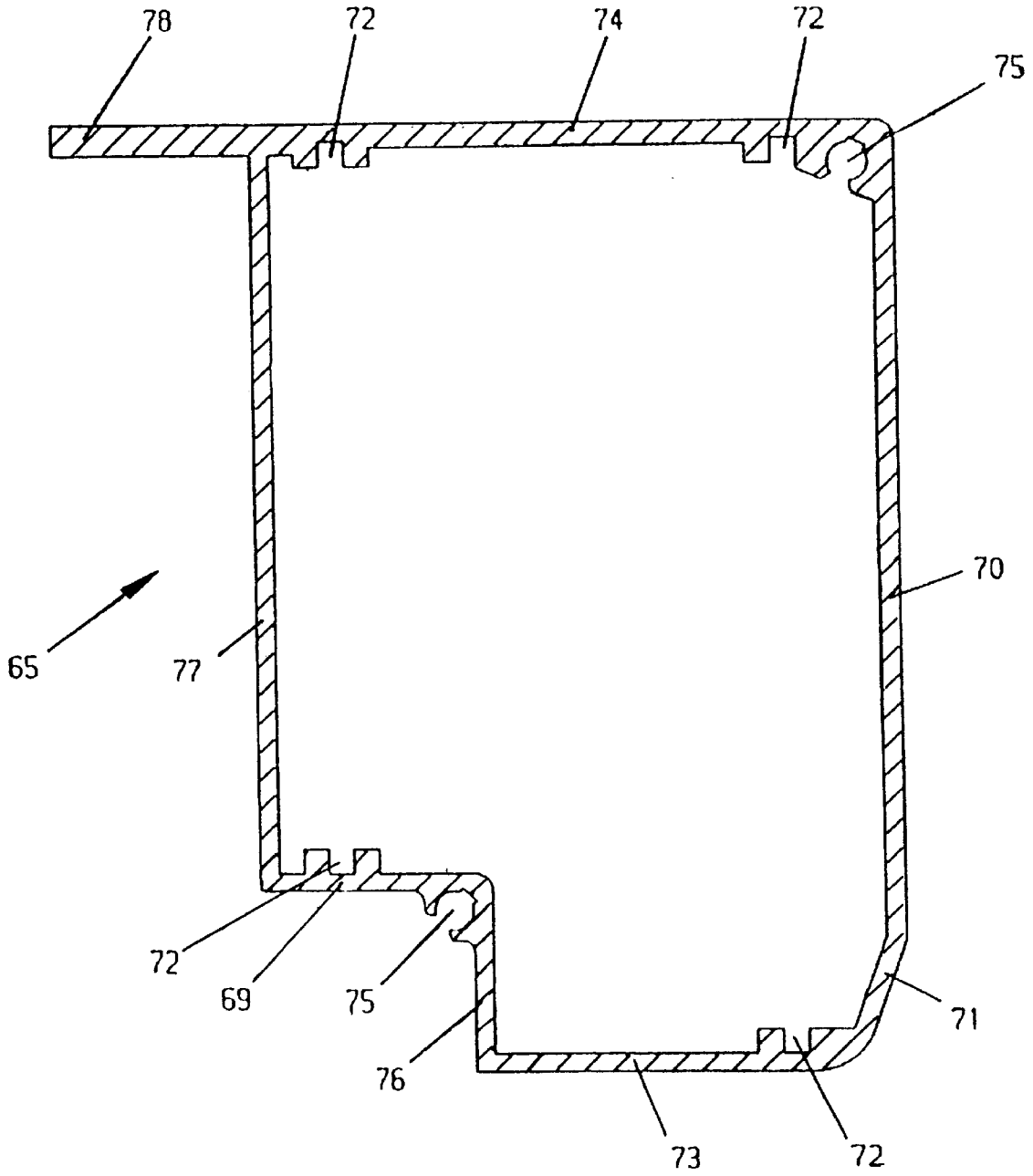
FIG. 7 shows a single sectional drawing of the integrated closed casing's form according to FIG. 6.

The closed casing 65 is separately illustrated in FIG. 7. The already mentioned leg 74 presents a protruding leg 78 whereby a leg 77 offset by approximately 90° with regard to leg 74 is conformed thereto. At the free end of leg 74 is also formed a leg 70 likewise offset by approximately 90°. The end portion of leg 70 presents a corner part 71, which leads into a leg 73 that is offset by approximately 90° with regard to leg 70. Likewise offset by approximately 90° is a leg 76 meeting again another leg 69 offset by approximately 90° thereto and directed towards leg 77. Within the closed room built by the legs 69, 70, 73, 74, 76 and 77, grooves 72 are found, into which may slide a boards for different control functions. There are moreover diagonally opposed screw channels 75 allowing the closure of the closed casing 65 at its fronts.

The running section 89 placed on the carrier leg 14 is, like the before mentioned components for the housing, cut to the required length. This running section 89 is interchangeable and may present different contours. The running section 89 lies on the supporting surface 16 with the therein integrated projection 15 of carrier leg 14. Due to the projection 15, the running section is blocked in its position and is retained respectively at its ends via trolley stoppers 92 which may be continuously fastened by means of clamping screws 91, as shown in FIG. 8. In this case the clamping screws act against the underside of carrier leg 14. The running surface 90 of running section 89 thus interacts with the employed rollers 61. Depending on the kind of stressing, different contour forms may be put to use.

Notched straps 80 are fixed to the housing inside at regular intervals as described, to properly close the housing with the closing section 2. The lower end of the notched strap 80 is provided with an actuation arm 88 rotatably located by means of a bedding 85. The actuation arm 88 presents on its one end a hook 87 engaging in the undercut 86 of closing section 2. In case the hook 87 engages, the closing section 2 is positively and non-positively connected with the header section 1. In case, however the actuation arm 88 is pivoted into the operation direction 119, the closing section 2 together with the terminal section 3 may be pivoted into the operation direction 120, with the ultimate effect that, past a certain angle, the complete closing section together with the terminal section may be removed. All this is possible preferably without essentially any tools. Joining of both housing components is likewise possible preferably without tools.

Figure 10:
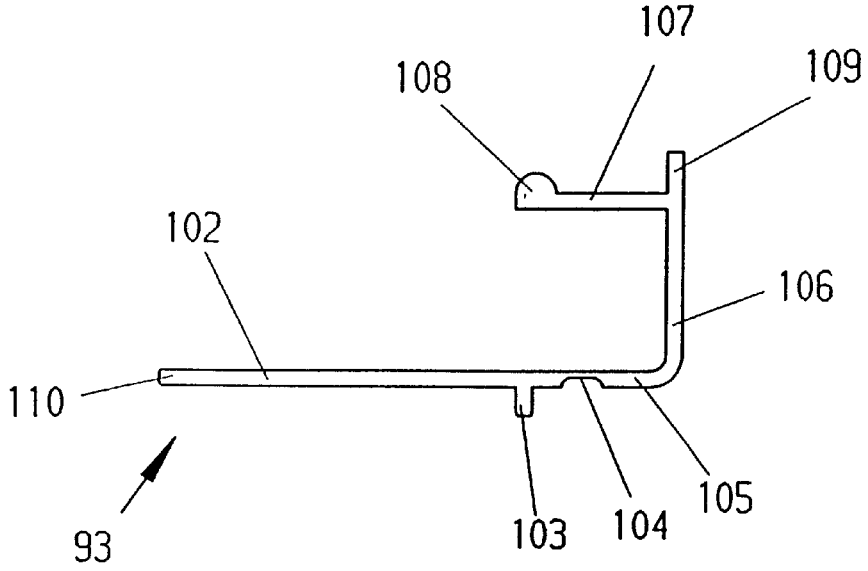
FIG. 10 shows a drawing of the cable duct section.
Figure 11:
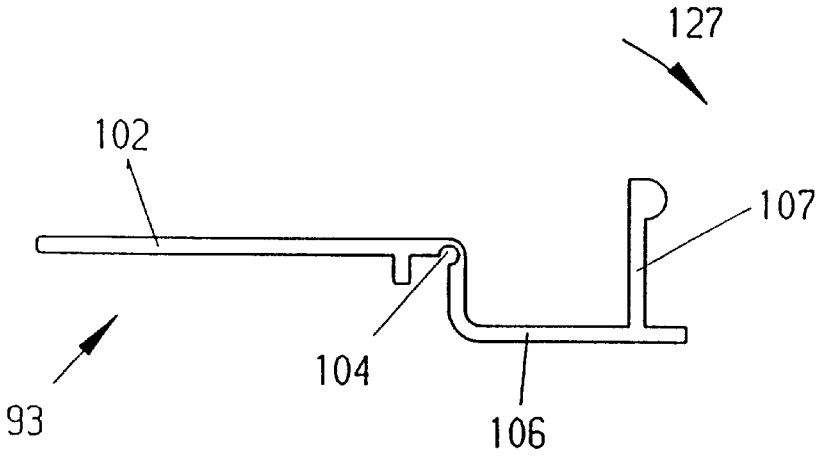
FIG. 11 shows a drawing of the cable duct section according to another possible embodiment of the present invention.

The hollow space 23 built inside the header section 1, may be used as a cable duct. For this application a special cable duct section 93, preferably made of plastic, is used. The cable duct section 93, as shown in FIGS. 10 and 11, basically presents a leg 102 and a leg 106. Leg end 110 of leg 102 engages into a groove 22 arranged at the end of support leg 10. A projection 103 is formed on leg 102 engaging in a groove 13. Thus the cable duct section 93 is fixed and may partially, due to its shape conception, which description follows below, fold out via an operation direction 127. For this purpose, contiguous with the leg 102 follows a tapered cross section 104, and the leg 105 following thereupon presents the same dimensions as the leg 102. The reduced cross section 104 allows the area of leg 106 to be pivotable with regard to leg 102 via the operation direction 127. In the closed position, the end portion of leg 109 is located at the locating face 111, which is placed at the projection 24. In order to realize a regular interengagement and thus a proper fit, another leg 107 offset by approximately 90° with regard to leg 106 is provided with a ball-shaped leg end portion 108. This leg end portion 108 engages in the hollow space 23.

In its end areas, the housing is screwed via the screw channels comprised in the sections, for example screw channel 37, by means of terminal parts. Thus a housing which is substantially easy to handle has been conceived in at least one embodiment of the present invention.

Figure 14:
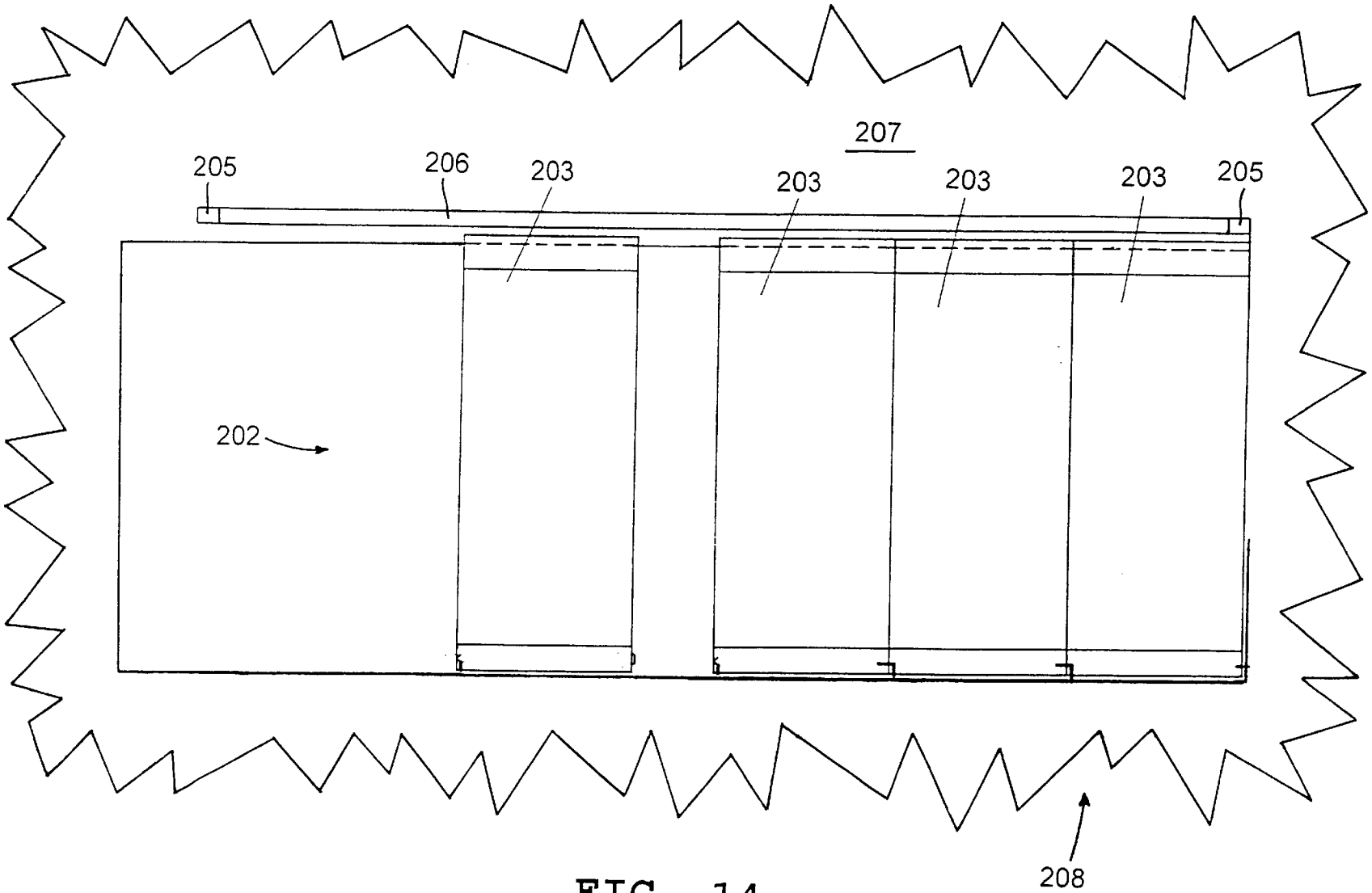
FIG. 14 shows a movable partition system having a housing according to at least one embodiment of the present invention.

FIG. 14 shows a movable partition system 202 having movable partitions 203 and a guide rail 204. The housing can be located adjacent to the guide rail 204, according to at least one embodiment of the present invention.

Figure 15:
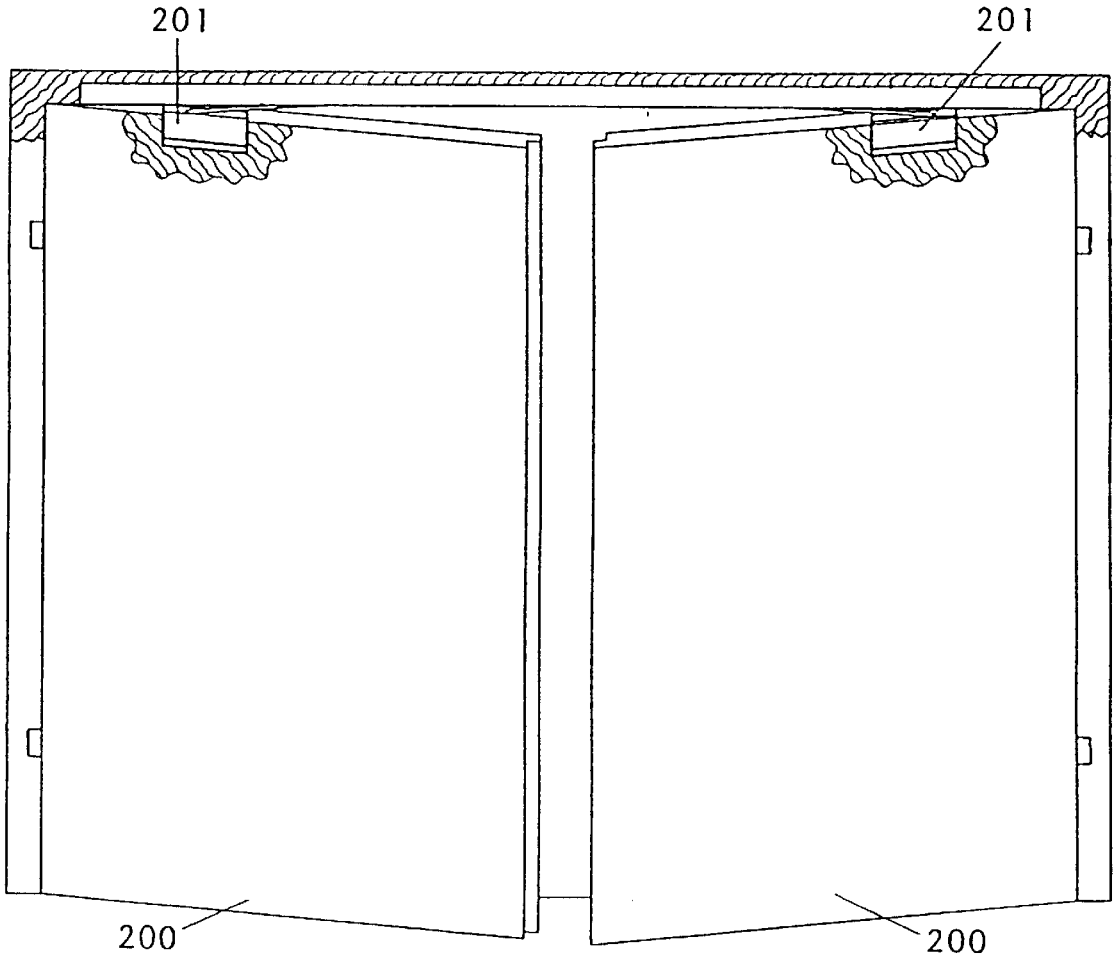
FIG. 15 shows a door system having a housing according to at least one embodiment of the present invention.

FIG. 15 shows a door system having door panels 200 and closing devices 201. The housing can be located adjacent the upper portion of the door system, according to at least one embodiment of the present invention.

One feature of the invention resides broadly in the housing, especially for automatic door operators, which especially serves to receive mechanical and electrotechnical components/such as running devices, suspension devices for movable door leaves, drive units comprising power transmissions, coupling, motor and displacement tracking equipment, auxiliary drives, controls/regulations, power pack, sensors etc., whereby the housing includes a header section 1 basically constructed of two legs 5, 25 arranged at an angle of approximately 90° towards each other and linked by a connecting leg 34, hooked and positively and non-positively fastened to a building by means of a base section via a location 8, which is placed at an angle of approximately 45 and conformed to the connecting leg 34 extending parallel thereto, and the leg 25 presents on its free end a rounded projection 33 to which is associated a towards the housing interior 125 directed undercut 27 conformed to a web 35, undercut becoming later a leg 32 extending parallel to the leg 25 and at the free end of leg 32 is arranged a deflecting holding leg 30 limited by a ball-shaped projection 28 and joined by a pivotable closing section 2 fixable by means of an interengagement, at which section's end is placed a terminal section 3 as well as end caps to be mounted at the header section's 1 fronts.

Another feature of the invention resides broadly in the housing characterized in that the terminal section 3 is limited by a leg 19 arranged at the leg's 5 free end.

Yet another feature of the invention resides broadly in the housing characterized in that the terminal section 3 stretches out as far as to the free leg 19.

Still another feature of the invention resides broadly in the housing characterized in that respectively one support leg 10 and one carrier leg 14, extending at an angle of approximately 90° from the leg 5, are directed towards the housing interior 125.

A further feature of the invention resides broadly in the housing characterized in that the support leg 10 displays a running surface 11 on one side executed to present a concave shape and that on the opposite side is found a straight locating face 12 which is provided with a groove 13 at the protruding end of support leg 10.

Another feature of the invention resides broadly in the housing characterized in that the carrier leg 14 shows a supporting surface 16, which is interrupted by a projection 15.

Yet another feature of the invention resides broadly in the housing characterized in that a running section 89 with a ball-type running surface 90 leans on the supporting surface 16 and is hold at its longitudinal ends by means of trolley stoppers 92 respectively lapping over the running section 89 and the carrier leg 14.

Still another feature of the invention resides broadly in the housing characterized in that at the leg 25 directed towards the housing interior 125 exists a projection 24 respectively a web 35 presenting each a mirror-inverted recess 26.

A further feature of the invention resides broadly in the housing characterized in that a cable duct section 93 is placed in at least partial zones of a hollow space 23 formed by the support leg 10, the connecting leg 34 and part of leg 25.

Another feature of the invention resides broadly in the housing characterized in that the cable duct section 93 is made of plastic and presents a straight leg 102, which besides a projection 103 is provided with a tapered cross section 104, with a leg offset by approximately 90° with regard to leg 102 and conformed thereto and another conformed leg 107 extending parallel to the leg 102, whereby simultaneously a cross section thickening is found at a leg end portion 108.

Yet another feature of the invention resides broadly in the housing characterized in that the closing section 2 basically consists of a straight leg 36, which has got a recess 44 on one end joined with leg 45 bent to the housing interior 125 which leg's end extends into an angled leg 46 and the other leg's end 36 extends directly into a bent leg 38.

Still another feature of the invention resides broadly in the housing characterized in that the free end of the bent leg 38 presents an offset recess 42 directed towards the housing interior 125, recess becoming a holding leg 41 with conformed ball-shaped projection 40.

A further feature of the invention resides broadly in the housing characterized in that the terminal section 3 is locatable at the free end of leg 45.

Another feature of the invention resides broadly in the housing characterized in that the terminal section 3 presents a slightly curved exterior contour interrupted by grooves 54.

Yet another feature of the invention resides broadly in the housing characterized in that the terminal section 3 is screwed respectively glued to the closing section 2 inside the housing interior 125.

Still another feature of the invention resides broadly in the housing characterized in that the closing section 2 is fastened to the header section 1 by means of a hook-shaped interlocking.

A further feature of the invention resides broadly in the housing characterized in that, in order to enlarge the housing, an additional header section 79 is employed between the header section 1 and the closing section 2.

Another feature of the invention resides broadly in the housing characterized in that a casing 65 for the control/regulation built by a profile is incorporated into the housing interior 125 realized by sections 1, 2, casing that is closed on its fronts by shutters.

Yet another feature of the invention resides broadly in the housing characterized in that the casing 65 consists of a hollow light metal section whereby grooves 72 for the reception of electrotechnical boards are simultaneously provided in the legs 69, 73, 74.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

AT LEAST PARTIAL NOMENCLATURE

1) Header section
2) Closing section
3) Terminal section
4) Brush channel
5) Leg
6) Fastening holes
7) Ramp
8) Location for base profile
9) Recess
10) Support leg
11) Running surface
12) Locating face
13) Groove
14) Carrier leg
15) Projection
16) Supporting surface
17) Hollow space
18) Projection
19) Leg
20) Aperture
21) Projection
22) Groove
23) Hollow space
24) Projection
25) Leg
26) Recess
27) Undercut
28) Ball-shaped projection -continued

| AT LEAST PARTIAL NOMENCLATURE |
|---|
| 29) Space |
| 30) Holding leg |
| 31) Curvature |
| 32) Leg |
| 33) Projection |
| 34) Connecting leg |
| 35) Web |
| 36) Leg |
| 37) Screw channel |
| 38) Leg |
| 39) Leg |
| 40) Ball-shaped projection |
| 41) Holding leg |
| 42) Recess |
| 43) Projection |
| 44) Recess |
| 45) Leg |
| 46) Leg |
| 47) Screw channel |
| 48) Straight projection |
| 49) Biased projection |
| 50) Edge |
| 51) Edge |
| 52) Projection |
| 53) Convex leg |
| 54) Groove |
| 55) Contour |
| 56) Surface |
| 57) Peak |
| 58) Indent |
| 59) Leg |
| 60) Ramp |
| 61) Roller |
| 62) Support roller |
| 63) Trolley |
| 64) Height adjustment |
| 65) Closed casing |
| 66) Board |
| 67) Mounting plate |
| 68) Screw connection |
| 69) Leg |
| 70) Leg |
| 71) Corner part |
| 72) Groove |
| 73) Leg |
| 75) Screw channel |
| 76) Leg |
| 77) Leg |
| 80) Additional header section |
| 81) Mounting plate |
| 82) Screw connection |
| 83) Corner part |
| 84) Attachment lever |
| 85) Bedding |
| 86) Undercut |
| 87) Hook |
| 88) Actuation arm |
| 89) Running section |
| 90) Running surface |
| 91) Clamping screws |
| 92) Trolley stoppers |
| 93) Cable duct section |
| 94) Leg |
| 95) Locating face |
| 96) Ball shaped conformation |
| 97) Offset |
| 98) Ball bed |
| 99) Locating face |
| 100) Locating face |
| 101) Projection |
| 102) Leg |
| 103) Projection |
| 104) Tapered cross section |
| 105) Leg |
| 106) Leg |
| 107) Leg |
| 108) Leg end portion |

-continued

| AT LEAST PARTIAL NOMENCLATURE |
|---|
| 109) Leg end portion |
| 110) Leg end |
| 111) Locating face |
| 112) Motor |
| 113) Retention plate |
| 114) Screw connection |
| 115) Retention bracket |
| 116) Drive pulley |
| 117) Opening area |
| 118) Mounting plate |
| 119) Operation direction |
| 120) Operation direction |
| 123) Curvature |
| 124) Liner |
| 125) Housing interior |
| 126) Projection |
| 127) Operation direction |

What is claimed is:

1. An openable and closable automatic door system comprising:

at least one door element;

at least one drive mechanism being configured and disposed to move said at least one door element;

a housing being configured to at least partially enclose said at least one drive mechanism;

said housing comprising a first leg and a second leg;

said second leg being configured to be mounted to a building structure;

said first leg being disposed substantially transverse to said second leg;

said first leg having a first end and a second end;

said second leg having a first end and a second end;

said first end of said first leg being connected to said first end of said second leg;

said housing comprising a removable portion;

said removable portion being configured to engage and disengage with said second end of said first leg;

said removable portion comprising:

a convex structure being disposed on said removable portion;

said convex structure having a cross-section having a substantially circular portion; and an indentation being disposed adjacent said convex structure;

said second end of said first leg comprising:

a convex structure;

said convex structure of said first leg having a cross-section having a substantially circular portion; and a web;

said web being disposed to connect said convex structure of said first leg to said second end of said first leg; and said web being disposed substantially transversely to said first leg;

said convex structure of said first leg being configured and disposed to engage with said indentation;

said removable portion being configured to be pivotable with respect to said first leg to permit said convex structure of said first leg to engage and disengage with said indentation;

said second end of said first leg further comprises:

a projection;

an extending leg having a first end and a second end;

a connecting portion;

said connecting portion is disposed substantially transverse to said first leg and substantially transverse to said extending leg;

said connecting portion is configured and disposed to connect said first leg and said extending leg adjacent said first end of said extending leg; and said extending leg is disposed substantially parallel to said first leg and extends past said projection;

said housing having a hollow interior;

a casing being disposed in said hollow interior and being mounted on said first leg;

said casing being configured to receive and house components for the automatic door system said convex and structure of said first leg and said web of said second end of said first leg are disposed on and substantially perpendicular to said second end of said extending leg.

2. The automatic door system according to claim 1, wherein:

said casing comprises a hollow metal section;

said metal section comprises a top section and a bottom section;

said metal section further comprises two side sections to connect said top section and said bottom section;

each of said top section and said bottom section comprises grooves disposed on a side thereof facing an interior of said casing; and said grooves being fad as to receive electrotechnical boards.

3. The automatic door system according to claim 2, wherein:

said connecting portion of said second end of said first leg forms an indentation; and said convex structure of said removable portion is configured and disposed to engage with said indentation of said second end of said first leg.

4. The automatic door system according to claim 3, wherein:

said housing comprises a connecting leg;

said connecting leg is configured and disposed to form the connection between said first end of said first leg and said first end of said second leg;

said connecting leg is disposed to form an obtuse angle with respect to said first leg; and said connecting leg is disposed to form an obtuse angle with respect to said second leg.

5. The automatic door system according to claim 4, wherein:

said connecting leg comprises an attachment structure configured to attach said housing to the building structure;

said attachment structure is connected to said connecting leg and extends substantially parallel to said connecting leg;

said removable portion having a first end and a second end;

said convex structure of said removable portion being disposed on said first end;

said removable portion having a terminal section; and said terminal section is connected to said second end of said removable portion.

6. The automatic door system according to claim 5, wherein:

said housing being configured to receive an end cap to close an end of said housing.

7. An openable and closable automatic door system comprising at least one door element and at least one drive mechanism configured and disposed to move said at least one door element, a housing being configured to at least partially enclose said at least one drive mechanism and having a hollow interior to contain components of said automatic door system, said housing comprising:

a first leg;

a second leg;

said second leg being configured to be mounted to a building structure;

said first leg being disposed substantially transverse to said second leg;

said first leg having a first end and a second end;

said second leg having a first end and a second end;

said first end of said first leg being connected to said first end of said second leg;

a removable portion;

said removable portion being configured to engage and disengage with said second end of said first leg;

said removable portion comprising:

a convex structure being disposed on said removable portion;

said convex structure having a cross-section having a substantially circular portion; and an indentation being disposed adjacent said convex structure; said second end of said first leg comprising:

a convex structure;

said convex structure of said first leg having a cross-section having a substantially circular portion; and a web;

said web being disposed to connect said convex structure of said first leg to said second end of said first leg; and said web being disposed substantially transversely to said first leg;

said convex structure of said first leg being configured and disposed to engage with said indentation;

said removable portion being configured to be pivotable with respect to said first leg to permit said convex structure of said first leg to engage and disengage with said indentation;

said second end of said first leg further comprising:

a projection;

an extending leg having a first end and a second end;

a connecting portion;

said connecting portion is disposed substantially transverse to said first leg and substantially transverse to said extending leg;

said connecting portion is configured and disposed to connect said first leg and said extending leg adjacent said first end of said extending leg; and said extending leg is disposed substantially parallel to said first leg and extends past said projection;

a casing being disposed in said hollow interior and being mounted on said first leg;

said casing being configured to receive and house the components of the automatic door system; and said convex structure of said first leg and said web of said second end of said first leg are disposed on and substantially perpendicular to said second end of said extending leg.

8. The automatic door system according to claim 7, wherein:

said casing comprises a hollow metal section;

said metal section comprises a top section and a bottom section;

said metal section further comprises two side sections to connect said top section and said bottom section;

each of said top section and said bottom section comprises grooves disposed on a side thereof facing an interior of said casing; and said grooves being configured to receive electrotechnical boards.

9. The automatic door system according to claim 8, wherein:

said connecting portion of said second end of said first leg forms an indentation; and said convex structure of said removable portion is configured and disposed to engage with said indentation of said second end of said first leg.

10. The automatic door system according to claim 9, wherein:

said housing comprises a connecting leg;

said connecting leg is configured and disposed to form the connection between said first end of said first leg and said first end of said second leg;

said connecting leg is disposed to form an obtuse angle with respect to said first leg; and said connecting leg is disposed to form an obtuse angle with respect to said second leg.

11. The automatic door system according to claim 10, wherein:

said connecting leg comprises an attachment structure configured to attach said housing to the building structure;

said attachment structure is connected to said connecting leg and extends substantially parallel to said connecting leg;

said removable portion having a first end and a second end;

said convex structure of said removable portion being disposed on said first end;

said removable portion having a terminal section; and said terminal section is connected to said second end of said removable portion.

12. The automatic door system according to claim 11, wherein:

said housing being configured to receive an end cap to close an end of said housing.

13. The automatic door system according to claim 12, wherein:

said second end of said second leg comprises a projection; and said terminal section extends towards said projection of said second leg when said indentation of said removable portion engages with said convex structure of said first leg.

14. The automatic door system according to claim 13, wherein:

said second leg comprises a support leg and a carrier leg;

said carrier leg is disposed between said second end of said second leg and said support leg; and each of said support leg and said carrier leg is configured and disposed to extend substantially perpendicular from the second leg toward said housing interior.

15. The automatic door system according to claim 14, wherein:

said support leg has a first side and a second side disposed opposite said first side;

said support leg comprises a running surface disposed on said first side of said support leg and facing said carrier leg;

said running surface has a substantially concave shape;

said support leg comprises a locating surface disposed on said second side of said support leg; and said locating surface comprises a groove.

16. The automatic door system according to claim 15, wherein:

said carrier leg has a first side and a second side disposed opposite said first side;

said carrier leg comprises a supporting surface disposed on said first side of said carrier leg; and said supporting surface comprises a projection.

17. The automatic door system according to claim 16, wherein:

said housing comprises a running section;

said running section is disposed on and connected to said supporting surface of said carrier leg;

said running section has a convex shape; and said housing comprises end stops disposed at each end of said running section to secure said running surface to said carrier leg.

18. The automatic door system according to claim 17, wherein:

said first leg comprises a projection disposed adjacent said first end of said first leg and extending toward said interior of said housing.

19. An openable and closable automatic door system comprising at least one door element and at least one drive mechanism configured and disposed to move said at least one door element, a housing being configured to at least partially enclose said at least one drive mechanism and having a hollow interior to contain components of said automatic door system, said housing comprising:

a first leg;

a second leg;

said second leg being configured to be mounted to a building structure;

said first leg being disposed substantially transverse to said second leg;

said first leg having a first end and a second end;

said second leg having a first end and a second end;

said first end of said first leg being connected to said first end of said second leg;

a removable portion;

said removable portion being configured to engage and disengage with said second end of said first leg;

said removable portion comprising:

a convex structure being disposed on said removable portion;

said convex structure having a cross-section having a substantially circular portion; and an indentation being disposed adjacent said convex structure;

said second end of said first leg comprising:

a convex structure;

said convex structure of said first leg having a cross-section having a substantially circular portion; and a web;

said web being disposed to connect said convex structure of said first leg to said second end of said first leg; and said web being disposed substantially transversely to said first leg;

said convex structure of said first leg being configured and disposed to engage with said indentation;

said removable portion being configured to be pivotable with respect to said first leg to permit said convex structure of said first leg to engage and disengage with said indentation;

said second end of said first leg further comprising:

a projection;

an extending leg having a first end and a second end;

a connecting portion;

said connecting portion is disposed substantially transverse to said first leg and substantially transverse to said extending leg;

said connecting portion is configured and disposed to connect said first leg and said extending leg adjacent said first end of said extending leg; and said extending leg is disposed substantially parallel to said first leg and extends past said projection; and said convex structure and said web of said second end of said first leg are disposed on and substantially perpendicular to said second end of said extending leg.

20. The automatic door system according to claim 19, wherein:

said housing comprises a casing disposed in said hollow interior and being mounted on said first leg;

said casing is configured to receive and house said components of the automatic door system;

said casing comprises a hollow metal section;

said metal section comprises a top section and a bottom section;

said metal section further comprises two side sections to connect said top section and said bottom section;

each of said top section and said bottom section comprises grooves disposed on a side thereof facing an interior of said casing;

said grooves being configured to receive electrotechnical boards;

said connecting portion of said second end of said first leg forms an indentation;

said convex structure of said removable portion is configured and disposed to engage with said indentation of said second end of said first leg;

said housing comprises a connecting leg;

said connecting leg is configured and disposed to form the connection between said first end of said first leg and said first end of said second leg;

said connecting leg is disposed to form an obtuse angle with respect to said first leg;

said connecting leg is disposed to form an obtuse angle with respect to said second leg;

said connecting leg comprises an attachment structure configured to attach said housing to the building structure;

said attachment structure is connected to said connecting leg and extends substantially parallel to said connecting leg;

said removable portion having a first end and a second end;

said convex structure of said removable portion being disposed on said first end of said removable portion;

said removable portion having a terminal section;

said terminal section is connected to said second end of said removable portion;

said housing being configured to receive an end cap to close an end of said housing;

said second end of said second leg comprises a projection;

said terminal section extends toward said projection of said second leg when said indentation of said removable portion engages with said convex structure of said first leg;

said second leg comprises a support leg and a carrier leg;

said carrier leg is disposed between said second end of said second leg and said support leg;

each of said support leg and said carrier leg is configured and disposed to extend substantially perpendicular from the second leg toward said housing interior;

said support leg has a first side and a second side disposed opposite said first side;

said support leg comprises running surface disposed on said first side of said support leg and facing said carrier leg;

said running surface has a substantially concave shape;

said support leg comprises a locating surface disposed on said second side of said support leg;

said locating surface comprises a groove;

said carrier leg has a first side and a second side disposed opposite said first side;

said carrier leg comprises a supporting surface disposed on said first side of said carrier leg;

said supporting surface comprises a projection;

said housing comprises a running section;

said running section is disposed on and connected to said supporting surface of said carrier leg;

said running section has a convex shape;

said housing comprises end Stops disposed at each end of said running section to secure said running section to said carrier leg; and said first leg comprises a projection disposed adjacent said first end of said first leg extending toward said interior of said housing.

* * * * *

UNITED STATES PATENT AND TRADEMARK OFFICE

CERTIFICATE OF CORRECTION

PATENT NO. : 6,557,303 B2
DATED : May 6, 2003
INVENTOR(S) : Andreas Finke and Andreas Althoff It is certified that error appears in the above-identified patent and that said Letters Patent is hereby corrected as shown below:

Title page, Item [54] and Column 1, line 2,
After "MECHANISMS" insert -- HAVING A REMOVABLE PORTION TO PERMIT ACCESS TO THE INTERIOR OF THE HOUSING --.

Column 1,
Delete lines 25 through 64, beginning with "In this case, …" and ending with "..any tools."
Line 66, after "Such", delete "profiles" and insert -- housings --.

Column 3,
Line 9, after "section" insert -- of a building structure. --

Column 4,
Line 28, after the first occurrence of "the", delete "-" and insert -- the protruding --.

Column 6,
Line 28, after "closed", delete "casing's form" and insert -- casing --.
Line 29, after "a" insert -- partial --.
Line 29, after "of" insert -- a portion of --.
Line 38, after the first occurrence of "a" insert -- partial --.
Line 38, after the second occurrence of "a" insert -- portion of a --
Lines 40-41, after "with", delete "a shutter of" and insert -- an additional section having an interengagement with --.

Column 8,
Line 30, after "undercut" insert -- or void --.
Line 31, after "45", delete "which forms" and insert -- to form --.
Line 47, after "-57.", delete "Here, the" and insert -- The --.
Line 48, after "located", delete "in the" and insert -- at intervals from the peak 57 to the end of the interior --.
Line 49, after "leg", delete "59 inside" and insert -- 59, which interior prolongation comprises --.

UNITED STATES PATENT AND TRADEMARK OFFICE

CERTIFICATE OF CORRECTION

PATENT NO. : 6,557,303 B2
DATED : May 6, 2003
INVENTOR(S) : Andreas Finke and Andreas Althoff It is certified that error appears in the above-identified patent and that said Letters Patent is hereby corrected as shown below:

Column 10,
Line 41, after "rail", delete "204." and insert -- located in a housing 206. --.
Line 41, after "housing" insert -- 206 --.
Line 42, after "adjacent" insert -- and mounted --.
Line 42, after the first occurrence of "to", delete "the guide rail 204," and insert -- a base section 207 of a wall or building structure 208, --.
Line 43, after "invention." insert -- The housing 206 also has end caps 205. --.

Column 12,
Between line 23 and line 24, insert the following:

--U.S. Patent No. 6,253,492, having an issue date of July 3, 2001, inventor Andreas Finke, and attorney docket No. NHL-DOR-61 entitled "HOUSING FOR AUTOMATIC DOOR MECHANISMS HAVING A HINGED CONNECTION" and claiming priority from International Application No. PCT/EP99/00808, filed on February 8, 1999 and Federal Republic of Germany Patent Application No. 198 04 859, filed on February 9, 1998, and U.S. Patent No. 6,199,321, having an issue date of March 13, 2001, inventor Lothar Ginzel, and attorney docket No. NHL-DOR-64, entitled "HOUSINGS FOR AUTOMATIC DOOR MECHANISMS, REVOLVING DOORS, SENSOR STRIPS, SENSOR STRIPS WITH INTEGRATED RAILS, AND SLIDING DOOR DRIVE SYSTEMS HAVING A FASTENING SYSTEM FOR END CAPS OF THE HOUSINGS, WHICH HOUSINGS ARE FORMED BY SECTIONS" and claiming priority from International Application PCT/EP99/00822, filed on February 9, 1999 and Federal Republic of Germany Patent Application No. 198 04 801.7, filed on February 9, 1998, are hereby incorporated by reference as if set forth in their entirety herein.--.

UNITED STATES PATENT AND TRADEMARK OFFICE

CERTIFICATE OF CORRECTION

PATENT NO. : 6,557,303 B2 
DATED : May 6, 2003
INVENTOR(S) : Andreas Finke and Andreas Althoff It is certified that error appears in the above-identified patent and that said Letters Patent is hereby corrected as shown below:

Column 15,
Line 17, after "system" insert -- ; --.
Line 18, after "convex" delete "and".
Line 33, after "being", delete "fad as" and insert -- configured --.

Column 18,
Line 34, after the second occurrence of "running", delete "surface" and insert -- section --.

Column 20,
Line 54, after the first occurrence of "end", delete "Stops" and insert -- stops --.

Signed and Sealed this

Seventh Day of October, 2003

JAMES E. ROGAN
*Director of the United States Patent and Trademark Office*